US012385652B2

(12) United States Patent
Boyle et al.

(10) Patent No.: US 12,385,652 B2
(45) Date of Patent: Aug. 12, 2025

(54) AIR TREATMENT SYSTEM AND METHOD OF TREATING AIR

(71) Applicant: FABRUM IP HOLDINGS LIMITED, Christchurch (NZ)

(72) Inventors: Christopher Patrick Boyle, Christchurch (NZ); Richard Hugh Reynolds, Christchurch (NZ)

(73) Assignee: FABRUM IP HOLDINGS LIMITED, Christchurch (NZ)

( * ) Notice: Subject to any disclaimer, the term of this patent is extended or adjusted under 35 U.S.C. 154(b) by 319 days.

(21) Appl. No.: 18/250,242

(22) PCT Filed: Oct. 22, 2021

(86) PCT No.: PCT/NZ2021/050188
§ 371 (c)(1),
(2) Date: Apr. 24, 2023

(87) PCT Pub. No.: WO2022/093043
PCT Pub. Date: May 5, 2022

(65) Prior Publication Data

US 2023/0400197 A1 Dec. 14, 2023

(30) Foreign Application Priority Data

Oct. 27, 2020 (NZ) ..... 769400

(51) Int. Cl.
*F24F 3/04* (2006.01)
*F24F 3/14* (2006.01)

(52) U.S. Cl.
CPC . *F24F 3/04* (2013.01); *F24F 3/14* (2013.01)

(58) Field of Classification Search
CPC ..... F24F 2005/0039; F24F 2110/70; F24F 2110/74; F24F 3/04; F24F 3/044;
(Continued)

(56) References Cited

U.S. PATENT DOCUMENTS 2,545,194 A 3/1951 Colburn et al.
4,337,071 A 6/1982 Yang
(Continued)

FOREIGN PATENT DOCUMENTS

CA 2486202 A1 5/2006
CN 1044162 A 7/1990
(Continued)

OTHER PUBLICATIONS

International Search Report and Written Opinion for International Application No. PCT/NZ2021/050188, dated Jan. 20, 2022, (11 pages), Australian Patent Office, Woden ACT, Australia.
(Continued)

*Primary Examiner* — Filip Zec
(74) *Attorney, Agent, or Firm* — Alston & Bird LLP

(57) ABSTRACT

An air treatment system (100) for treating air of an inhabited space (1). The air treatment system has an air preparation module (3) and a cryogenic module (5). The air preparation module (3) is configured to receive air extracted from the inhabited space (1) and is configured to increase the pressure of the extracted air so as to increase the density and decrease the moisture content of the extracted air, thereby converting the extracted air into dry air. The cryogenic module (5) is coupled to the air preparation module (3) to receive the dry air and is configured to decrease a temperature of the dry air such that at least part of at least one component of the dry air is separated and removed from the dry air thereby converting the dry air into treated air for delivery into the inhabited space (1).

20 Claims, 1 Drawing Sheet

(58) Field of Classification Search
CPC ..... F24F 3/14; F24F 3/16; F24F 8/10; F24F 8/98; F24F 2003/144; F24F 8/95
See application file for complete search history.

(56) References Cited

U.S. PATENT DOCUMENTS

| | | | | |
|---|---|---|---|---|
| 4,918,939 | A | 4/1990 | Fresch et al. | |
| 4,964,901 | A | 10/1990 | Rhode | |
| 6,312,328 | B1 | 11/2001 | Nakajima et al. | |
| 7,210,312 | B2 * | 5/2007 | Unger | A61M 16/101 62/643 |
| 8,171,742 | B2 | 5/2012 | Caughley et al. | |
| 9,366,244 | B2 | 6/2016 | Caughley | |
| 11,773,754 | B2 * | 10/2023 | Ayachi | F01K 25/10 60/671 |
| 2008/0000352 | A1 | 1/2008 | Howard et al. | |
| 2017/0234614 | A1 | 8/2017 | Lautenschlager et al. | |
| 2019/0331418 | A1 | 10/2019 | Prosser et al. | |
| 2020/0333026 | A1 * | 10/2020 | Pletincx | F24F 5/0021 |
| 2021/0008464 | A1 * | 1/2021 | Belancik | B01D 7/00 |
| 2021/0260518 | A1 | 8/2021 | Ling et al. | |
| 2021/0381703 | A1 * | 12/2021 | Masuda | B01D 53/261 |

FOREIGN PATENT DOCUMENTS

| | | | |
|---|---|---|---|
| CN | 108452632 | A | 8/2018 |
| CN | 106716033 | B | 3/2020 |
| GB | 1116494 | A | 6/1968 |
| JP | H03-263527 | A | 11/1991 |
| RU | 2162722 | C1 | 2/2001 |

OTHER PUBLICATIONS

European Patent Office, Extended European Search Report received for Application No. 21887006.1, dated Sep. 9, 2024, 9 pages, Germany.

* cited by examiner

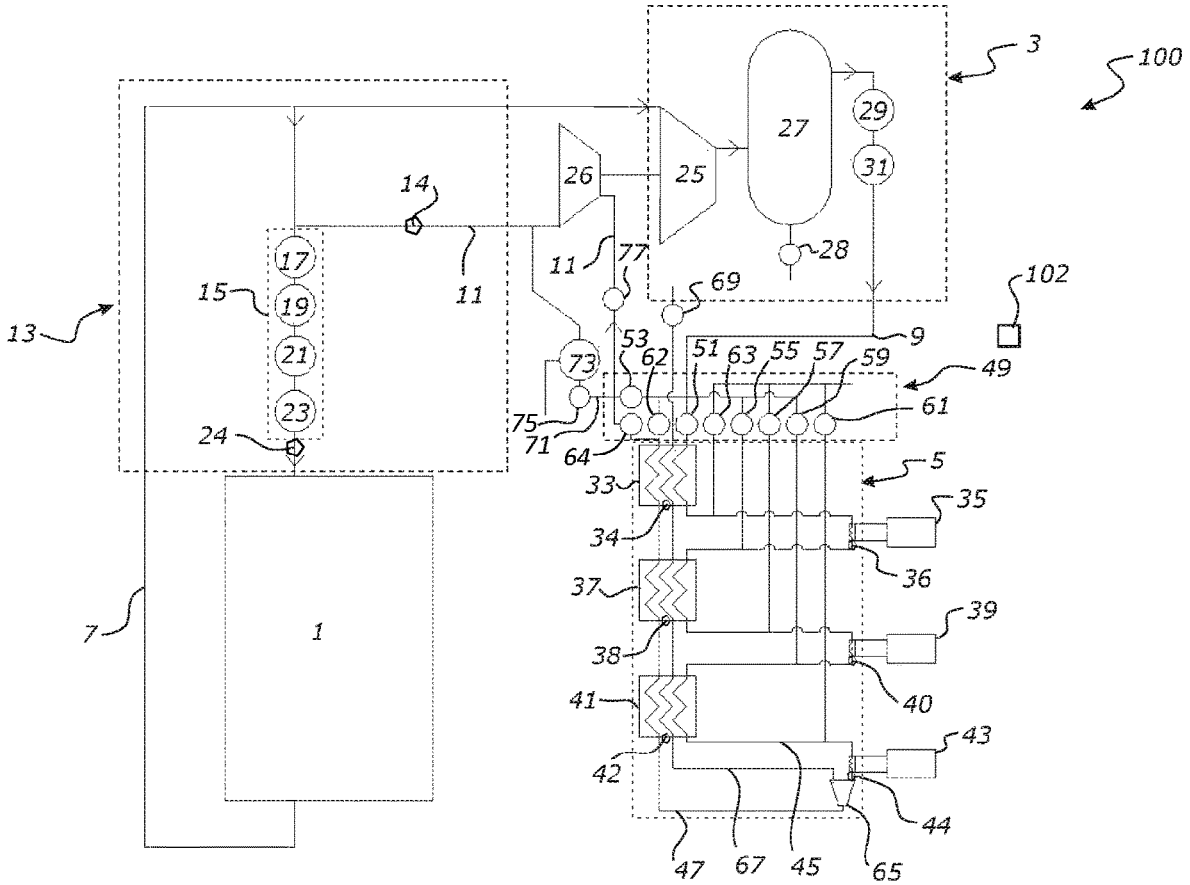
3
100
27
29
31
26
25
14
28
11
77
69
102
13
15
17
19
21
23
11
9
53
62
51
63
55
57
59
49
73
61
75
71
64
24
5
33
35
34
36
37
39
7
1
38
40
41
43
42
44
47
67
45
65

AIR TREATMENT SYSTEM AND METHOD OF TREATING AIR

CROSS REFERENCE TO RELATED APPLICATIONS

This application is a National Stage Application, filed under 35 U.S.C. § 371, of International Application No. PCT/NZ2021/050188, filed Oct. 22, 2021, which claims priority to and the benefit of New Zealand Application No. 769400, filed Oct. 27, 2020; the contents of both of which as are hereby incorporated by reference in their entireties.

FIELD OF THE INVENTION

This invention relates to an air treatment system and method of treating air.

BACKGROUND

The quality of air of an inhabited space is important for maintaining or improving the quality of life and health of the occupants within the inhabited space. Air quality of an inhabited space is typically controlled by an air conditioning system which adjusts the temperature and humidity of air and recirculates it within the space. Some air conditioners also include particle filters which reduce the particulate content of the air. While air conditioning may improve the general comfort of occupants within the room, it does not significantly improve the actual quality of the air being breathed.

When a space is inhabited by more people than expected and/or for an extended duration, the quality of air in the inhabited space can reduce due to the build-up of carbon dioxide. This can cause occupants of the inhabited space to become tired.

Some air purification systems reduce the quantity of non-oxygen components of air which helps improve the quality of the air. However, many air purification systems are limited in the range and extent to which they can remove pollutants.

It is an object of at least preferred embodiments of the present invention to provide an air treatment system and method of treating air that improves the quality of air of an inhabited space and/or to at least provide the public with a useful alternative.

SUMMARY OF THE INVENTION

In a first aspect of the invention, there is provided an air treatment system for treating air of an inhabited space, the air treatment system comprising: an air preparation module configured to receive air extracted from the inhabited space and configured to increase the pressure of the extracted air so as to increase the density and decrease the moisture content of the extracted air, thereby converting the extracted air into dry air; and a cryogenic module coupled to the air preparation module to receive the dry air and configured to decrease a temperature of the dry air such that at least part of at least one component of the dry air is separated and removed from the dry air thereby converting the dry air into treated air for delivery into the inhabited space.

In some embodiments, the air treatment system further comprises an air handling module coupled to the air treatment system and configured to extract the air from the inhabited space and deliver it to the air preparation module and/or configured to receive the treated air from the cryogenic module and deliver it into the inhabited space.

In some embodiments, the air treatment system is configured such that a volume flow rate of the extracted air received by the air preparation module and/or an amount of increase in the pressure of the extracted air is determined by at least one current property of at least one component of the air within the inhabited space.

In some embodiments, the cryogenic module comprises: at least one heat exchanger through which the dry air and the treated air pass and configured to capture the at least part of at least one component of the dry air to separate and remove the at least part of the at least one component from the dry air; and at least one cryogenic cooler coupled to the at least one heat exchanger and configured to control the temperature of the at least one heat exchanger.

In some embodiments, the air preparation module comprises: a compression device configured to increase pressure of the extracted air to increase the density of the extracted air; a moisture collection arrangement configured to capture moisture content from the extracted air during and/or after the increase in pressure and density of the extracted air; and at least one particle filter configured to capture particulate content from the extracted air after the decrease in moisture content of the extracted air.

In some embodiments, the air treatment system further comprises a nitrogen discharge module configured to receive at least part of the dry air to decrease a concentration or partial pressure of a nitrogen component of the dry air prior to receipt of the dry air by the cryogenic module.

In some embodiments, a volume flow rate of the at least part of the dry air received by the nitrogen discharge module is determined by a concentration of an oxygen component of the dry air and/or a concentration of an oxygen component of the air within the inhabited space.

In some embodiments, the air treatment system further comprises a nitrogen discharge module configured to receive at least part of the treated air to decrease a concentration or partial pressure of a nitrogen component of the treated air prior to delivery of the treated air into the inhabited space.

In some embodiments, a volume flow rate of the at least part of the treated air received by the nitrogen discharge module is determined by a concentration of an oxygen component of the treated air and/or a concentration of an oxygen component of the air within the inhabited space.

In some embodiments, the cryogenic module is configured such that at least a part of the energy required to decrease the temperature of the dry air as it passes through the at least one heat exchanger is recovered by the passage of the treated air through the at least one heat exchanger.

In some embodiments, the air treatment system is configured such that at least a part of the energy required to increase the density of the extracted air is recovered by directing the treated air through an expansion device coupled to the compression device before it is delivered into the inhabited space.

In some embodiments, the air treatment system further comprises a purging arrangement configured to remove the at least part of the at least one component of the dry air captured by the at least one heat exchanger from the at least one heat exchanger.

In some embodiments, the air treatment system is configured such that, during removal of the at least part of the at least one component of the dry air from the at least one heat exchanger by the purging arrangement, the dry air is directed from the air preparation module for delivery into the inhabited space.

In some embodiments, the cryogenic module is configured such that an amount of the decrease in temperature of the dry air is determined by at least one property of the at least one component of the air within the inhabited space.

In some embodiments, the at least one property of the at least one component of the air within the inhabited space comprises a condensation temperature and/or a de-sublimation temperature.

In some embodiments, the at least one current property of the at least one component of the air within the inhabited space comprises a concentration of the at least one component or a partial pressure of the at least one component, and wherein the at least one component of the air within the inhabited space and the at least one component of the dry air comprises an oxygen component, a carbon dioxide component, a nitrogen component, a sulfur dioxide component, a formaldehyde component, a hydrogen sulfide component, a hydrogen disulfide component or an ozone component.

In some embodiments, the air treatment system is configured to increase a concentration or partial pressure of an oxygen component of the treated air prior to delivery of the treated air into the inhabited space.

In some embodiments, the air handling module is configured to measure and control a temperature, pressure, density and/or humidity of the treated air prior to delivery of the treated air into the inhabited space.

In some embodiments, the air handling module comprises an air conditioning system.

In a second aspect of the invention, there is provided a method of treating the air of an inhabited space, the method comprising: extracting the air from the inhabited space;

increasing the pressure of the extracted air so as to increase the density and decrease the moisture content of the extracted air, thereby converting the extracted air into dry air; decreasing the temperature of the dry air such that at least part of at least one component of the dry air is separated and removed from the dry air, thereby converting the dry air into treated air; and delivering the treated air into the inhabited space.

In some embodiments, the method further comprises measuring at least one current property of at least one component of the air within the inhabited space and controlling a volume flow rate of the extracted air received by the air preparation module and/or controlling an amount of increase in the pressure of the extracted air based on the measured at least one current property.

In some embodiments, the method further comprises measuring a concentration of an oxygen component of the dry air and/or a concentration of an oxygen component of the air within the inhabited space and decreasing a concentration or partial pressure of a nitrogen component of the dry air based on the measured concentration prior to the decrease in temperature of the dry air.

In some embodiments, the method further comprises measuring a concentration of an oxygen component of the treated air and/or a concentration of an oxygen component of the air within the inhabited space and decreasing a concentration or partial pressure of a nitrogen component of the treated air based on the measured concentration prior to delivery of the treated air into the inhabited space.

In some embodiments, the method further comprises controlling an amount of the decrease in temperature of the dry air based on at least one property of the at least one component of the air within the inhabited space.

In some embodiments, the at least one property of the at least one component comprises a condensation temperature and/or a de-sublimation temperature.

In some embodiments, the measured at least one current property of the at least one component of the air within the inhabited space and the measured at least one current property of the at least one component of the dry air comprises a concentration of the at least one component or a partial pressure of the at least one component, and wherein the at least one component of the air within the inhabited space and the at least one component of the dry air comprises an oxygen component, a carbon dioxide component, a nitrogen component, a sulfur dioxide component, a formaldehyde component, a hydrogen sulfide component, a hydrogen disulfide component or an ozone component.

In some embodiments, the method further comprises increasing a concentration or partial pressure of an oxygen component of the treated air prior to delivery of the treated air into the inhabited space.

In some embodiments, the method further comprises measuring and controlling a temperature, pressure, density and/or humidity of the treated air prior to delivery of the treated air into the inhabited space.

In some embodiments, the method is performed using the air treatment system of the first aspect of the invention outlined above or herein.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term '(s)' following a noun means the plural and/or singular form of that noun.

As used herein the term 'and/or' means 'and' or 'or', or where the context allows both. The invention consists in the foregoing and also envisages constructions of which the following gives examples only.

BRIEF DESCRIPTION OF THE DRAWINGS

The present invention will now be described by way of example only and with reference to the accompanying drawings in which:

FIG. 1 shows a schematic layout of an exemplary embodiment of an air treatment system.

DETAILED DESCRIPTION OF A PREFERRED EMBODIMENT

FIG. 1 shows a schematic layout of an exemplary embodiment of the present invention. This embodiment will be used to describe the general working principles and features of the air treatment system, but may include features specific to this embodiment and/or features optional to the general functioning of the air treatment system.

The air treatment system 100 shown in FIG. 1 is provided to treat the air of the inhabited space 1. That system 100 is primarily composed of two main modules, an air preparation module 3 and a cryogenic module 5.

The inhabited space could be any suitable space, such as a room, office, or other interior space for containing occupants. The system can operate or be configured for inhabited spaces of different sizes and/or for spaces that are to be inhabited by different numbers of occupants. For example, the air treatment system 100 may be configured to treat the air in a small inhabited space having only one occupant, such as a room of a domestic household, a room of medium size for multiple occupants, or a large inhabited space having several hundreds or thousands of occupants, such as an auditorium, stadium, or the like.

The air preparation module 3 is configured to receive air extracted from the inhabited space 1, illustrated by extracted air line 7 shown exiting from the inhabited space 1. The air preparation module 3 is configured to increase the pressure of the extracted air so as to increase the density and decrease the moisture content of the extracted air. This substantially converts the extracted air into dry air. The air preparation module 3 is described in greater detail below.

By way of example, normal air would typically have 6-10 grams of water per cubic metre of air. In some configurations, the dry air has less than about 0.75 grams of water per cubic metre, optionally less than about 0.5 grams of water per cubic metre.

The cryogenic module 5 is coupled to the air preparation module 3 to receive the dry air from the air preparation module 3. The dry air is supplied by the dry air line 9, shown exiting the air preparation module 3 and entering the cryogenic module 5. The cryogenic module 5 is configured to decrease a temperature of the dry air such that at least part of at least one component of the dry air is separated and removed from the dry air. This substantially converts the dry air into treated air for delivery into the inhabited space 1. The treated air is delivered back towards the inhabited space through treated air line 11. The features of the cryogenic module 5 responsible for this conversion are described in greater detail below.

The present specification describes various components of the system being 'coupled to' each other. Generally, that should be interpreted as the components being in fluid communication with each other so that fluid such as gas for example, can travel between the components.

FIG. 1 also shows that the inhabited space 1 is coupled to an air handling module 13. The air handling module 13 is itself also coupled to the air treatment system 100. The air handling module 13 is configured to extract the air from the inhabited space 1 and deliver it to the air preparation module 3. Alternatively, or additionally, the air handling module 13 is configured to receive the treated air from the cryogenic module 5 and deliver it into the inhabited space 1. As such, the air handling module 13 is shown comprising at least part of the extracted air line 7 and the treated air line 11, respectively leading out of and into the inhabited space 1.

In this way, the air handling module 13 is primarily responsible for extracting, returning and thereby recirculating the air of the inhabited space 1. Further, the air handling module 13 is configured to measure and control a temperature, pressure, density and/or humidity of the treated air prior to delivery of the treated air into the inhabited space 1. The air handling module 13 may also measure and monitor a temperature, pressure, density and/or humidity of the extracted air prior to its delivery to the air preparation module 3 of the air treatment system 100.

These functions are performed by the air handling unit 15 of FIG. 1, which may include components such as, for example, a fan 17 for extracting/returning/recirculating air of the inhabited space 1; a filter 19 for trapping any particulates circulating within the air handling module 13; as well as a humidity control device 21, such as a humidifier, and a temperature control device 23, such as a heat exchanger or the like.

Those skilled in the art will appreciate that the air handling unit 15 may encompass any conventional air handling system, such as an air conditioning system of a building which houses the inhabited space 1. Therefore, the air handling module 13 may be, or comprise, an air conditioning system.

The air handling module 13 being provided separate and external from the air treatment system 100 demonstrates the adaptivity of the air treatment system 100 with existing air handling systems of an inhabited space. This adaptivity allows the air treatment system 100 to treat the air of an inhabited space already having an air handling or air conditioning system provided therefor.

However, in some embodiments, the air handling module 13 may form part of, or be housed by, the air treatment system 100. Such an embodiment may be used to treat the air of an inhabited space that does not already possess an air handling or air conditioning system. In such an embodiment, the air handling module 13 still comprises the same features and working principles as described above, however they are integrated in between the output of the cryogenic module 5 and re-entry of the treated air into the inhabited space 1, for instance along treated air line 11.

In any case, the air treatment system 100 will be arranged to treat the air within the inhabited space 1, resulting in changes to various properties of the air, such as pressure, density, humidity, and/or temperature. These properties may be adjusted by the air handling module 13 back to occupant-friendly parameters, regardless of whether the air handling module 13 is incorporated in the air treatment system 100 or not.

Measurement of the treated air passing along the treated air line 11 may be performed with pre-correction sensor 14. Measurements by pre-correction sensor 14 may be used to determine the operating parameters of the air handling unit 15, and how much temperature, pressure, density and/or humidity correction is required. Correction by the air handling unit 15 may then be followed by and monitored by post-correction sensor 24 which may check the accuracy of correction and thus form a feedback loop with pre-correction sensor 14 to continuously ensure appropriate real-time correction of the treated air prior to delivery of the treated air into the inhabited space 1. Other sensor arrangements may be contemplated by those skilled in the art for measuring and monitoring treated air or extracted air as required.

Further, the air handling module 13 may circulate air from and to the inhabited space 1 at a significantly higher volume flow rate compared to the volume flow rate at which air is passed through the air treatment system 100. Therefore, the volume of air passing through the air treatment system 100 being treated at any given time may be substantially lower than the total volume being recirculated in the inhabited space 1. This assists with the corrections needed by the air handling module 13 to return the treated air back to occupant-friendly parameters being manageable, since the volume of the treated air that may need correction will typically be much smaller than the volume of total air handled by the module; thereby providing stable, gradual adjustment and control of air properties, and uniform distribution of said air within the inhabited space 1.

Further, the ratio of air recirculated by the air handling module 13 to the air treated by the air treatment system 100 may be configured based on the ratio of the volume of the inhabited space 1 to the number of occupants within said inhabited space 1. For instance, a small room with a large number of occupants may have substantially all of the air passed through and treated by the air treatment system 100, whereas a large room with a comparably small number of occupants may have, for example, about 10% of the air total air volume passed through and treated by the air treatment system 100.

Configuring the ratio of air flows as such effectively balances occupant health/comfort with energy efficiency of the system, in that excess energy is not consumed by the air treatment system 100 to treat air at a rate that exceeds that required for optimal occupant health. In some instances, for example when installed in a large building with multiple inhabited spaces of varying volumes and occupancy levels, the air treatment system 100 may be configured to direct the volume of treated air to inhabited spaces having their own discrete air handling modules/air conditioning systems, based on the desired air quality for those inhabited spaces and/or based on the volume of those inhabited spaces relative to their occupancy levels, as described above.

The air treatment system 100 treats the air via the air preparation module 3 and cryogenic module 5. The features of the air preparation module 3 and cryogenic module of this embodiment of the system 100 of FIG. 1 will now be described in further detail.

The air preparation module 3 shown in FIG. 1 comprises a compression device 25. This compression device 25 receives extracted air from the extracted air line 7, and is configured to increase pressure of the extracted air to increase the density of the extracted air. The compression device can encompass any known compressor or the like, and increases the pressure and density of the extracted air to facilitate moisture removal from the air. The increase in pressure and density of the extracted air also helps to facilitate removal of the at least one component by the cryogenic module 5, described in further detail below.

An optional expansion device 26 is shown coupled to the compression device 25. The expansion device 26 can encompass any known expander or the like, and is fed by the treated air line 11 exiting the cryogenic module 5 described in further detail below. As the treated air passing through treated air line 11 has already undergone the increase in pressure and density, its passage through the expansion device 26 (which is configured to decrease pressure of the treated air to decrease the density of the treated air) will help to return the treated air to a pressure and density that is occupant-friendly. The operation of the expansion device 26, being operatively coupled to the compression device 25, will also concurrently provide energy for the compression device 25, in a similar manner to known combined compressor/expander devices.

In this way, the air treatment system 100 may be configured such that at least a part of the energy required to increase the density of the extracted air is recovered by directing the treated air through an expansion device 26 coupled to the compression device 25 before it is delivered into the inhabited space 1.

The expansion device 26 may form part of the air preparation module 3, as shown, or may alternatively form part of the air handling module 13, or be incorporated in a position between those modules. In embodiments where the expansion device 26 is not provided, the air handling module 13 may instead itself correct the pressure and density of the treated air prior to its re-entry into the inhabited space 1.

Returning to the principle functions of the air preparation module 3, the increase in pressure and density of the extracted air causes the moisture content within the air to condense into liquid droplets. The pressurised, denser air then passes through a moisture collection arrangement 27 configured to capture moisture content from the extracted air during and/or after the increase in pressure and density of the extracted air.

In the embodiment shown, the moisture collection arrangement 27 comprises a wet air receiver chamber 27 arranged downstream of the compression device 25. The moisture collection arrangement 27 captures the moisture content after the increase in pressure and density of the extracted air by the compression device 25, rather than during that increase in pressure. However, other embodiments of the moisture collection arrangement 27 may include other means which capture moisture content concurrently with the operation of the compression device 25.

The wet air receiver chamber 27 in this embodiment is configured and sized sufficiently to collect the condensate water droplets. The water droplets can then be exhausted out of the moisture collection arrangement 27 with any suitable means known in the art, such as an automatic valve 28.

At least one particle filter 29 is positioned downstream of the moisture collection arrangement 27. The at least one particle filter 29 is configured to capture particulate content from the extracted air after the decrease in moisture content of the extracted air. The at least one particle filter 29 can comprise any suitable filter type for capturing particulate content. For example, mechanical filters with appropriately sized meshing, chemical filters, Volatile Organic Compound (VOC) filters with activated charcoal or carbon, coalescing moisture or oil filters, and the like.

To further ensure minimal moisture content in the dry air, the air preparation module 3 may optionally comprise a final drying stage in the form of a dryer device 31 such as a desiccant bed or refrigerant drier, shown in FIG. 1 arranged after the at least one particle filter 29. The dryer device 31 does not form an essential part of the air preparation module 3 but presents an example of the sort of additional components that may be added by those skilled in the art to supplement the principle functions of the air treatment system 100.

The substantial removal of moisture content and subsequent removal of particulate content from the pressurised and condensed extracted air converts the extracted air into substantially dry, substantially particulate-free air.

The conversion into substantially dry, substantially particulate-free air is important for the functioning of the cryogenic module 5 described below. The cryogenic module 5 includes cryogenic coolers and heat exchangers operating at extremely low temperatures. The air passing through these components of the cryogenic module 5 is beneficially substantially moisture free to avoid rapid build-up of frozen water, and substantially particulate free to avoid clogging of components, both of which may decrease the efficiency and potentially damage components operating at these cryogenic temperatures. Those skilled in the art will appreciate that the air does not need to be completely dry or completely particulate free, and that some residual moisture and some residual particulate content may be present in the substantially dry, substantially particulate-free air.

The extent to which the dry air is moisture and particulate-free may depend on the commercial requirements for a given application. For instance, in general domestic or commercial applications, the air preparation module 3 may be configured to convert the extracted air into dry air that substantially fulfils International Standards Organisation (ISO) Compressed Air Quality Class 1.2.1, wherein: particulate content of the compressed air is such that each cubic metre of compressed air has less than 20,000 particles in the 0.1-0.5 micron size range, 400 particles in the 0.5-1 micron size range and 10 particles in the 1-5 micron size range; moisture content of the compressed air is such that it has a pressure dewpoint of −40° C.; and oil quality of the compressed air is such that it has no more than 0.01 milligrams of oil per cubic metre. In other applications and configurations, the dry air may fulfil any other ISO or non-ISO air quality classes.

The cryogenic module 5 receives the substantially dry, substantially particulate-free air via dry air line 9. The cryogenic module 5 comprises at least one heat exchanger 33 through which the dry air and the treated air pass. The cryogenic module 5 also comprises at least one cryogenic cooler 35 coupled to the at least one heat exchanger 33 and configured to control the temperature of the at least one heat exchanger 33.

The cryogenic cooler 35 may take the form of any suitable cryogenic cooler type or configuration, for example, a Stirling cryocooler, a Turbo-Brayton cryocooler or a Pulse-tube cryocooler. The choice of cryogenic cooler 35 type may be determined by commercial requirements; however, in an exemplary embodiment, the cryogenic cooler may take the form of a free-piston Stirling cryocooler, powered by either a mechanical pressure wave generator or a linear electric motor pressure wave generator. By way of example, the cryogenic cooler(s) or cryocooler(s) may be of the type described in U.S. Pat. Nos. 8,171,742 and 9,366,244. The contents of those specifications are incorporated herein in their entirety by way of reference.

The cryogenic cooler 35 being coupled to the heat exchanger 33 in effect determines the temperature range at which the heat exchanger 33 operates. Cryogenic cooling of the dry air takes place as the dry air passes through the heat exchanger 33. As described above, the decrease in temperature of the dry air is such that at least part of at least one component of the dry air is separated and removed from the dry air. In some configurations substantially all of at least one component of the dry air is separated and removed from the dry air.

The at least one heat exchanger 33 is therefore configured to capture the at least part of at least one component of the dry air to separate and remove the at least part (or substantially all) of the at least one component from the dry air.

This in effect describes the main principle of the air treatment system 100, whereby the concentration, proportion or partial pressure of undesirable component(s) of air of an inhabited space are selectively reduced to provide treated air.

The cryogenic module 5, and thus cryogenic cooler 35 and heat exchanger 33, is/are configured such that an amount of the decrease in temperature of the dry air is determined by at least one property of the at least one component of the air within the inhabited space 1.

For the purposes of cryogenic cooling, the at least one property of the at least one component of the air within the inhabited space 1 comprises a condensation temperature and/or a de-sublimation temperature. At low temperatures, many gaseous components of an air stream will condensate into liquid droplets via a phase change known as condensation. At even lower temperatures, gaseous components of an air stream will skip the liquid phase entirely and transition from a gaseous state into a solid state via a phase change known as de-sublimation. In either case, the extremely low temperatures of the cryogenic cooler 35 are imparted on the respective heat exchanger 33, causing at least part of the at least one component of the air passing therethrough to condense or de-sublimate onto a surface of the heat exchanger 33, and thus be captured by the heat exchanger 33.

Therefore, the temperature of the cryogenic cooler 35 will be configured such that the operating temperature range of the heat exchanger 33 encompasses the condensation and/or de-sublimation temperature of a component of the air requiring removal. For instance, if the at least one component of the dry air is a carbon dioxide component, since carbon dioxide starts to de-sublimate at or below −80° C., the temperature of the cryogenic cooler 35 will be configured such that the operating temperature range of the heat exchanger 33 is at about −80° C. to about −140° C., for example. The lower the operating temperature below the condensation or de-sublimation temperature of a given component, the greater the proportion of that component is removed from the dry air. Therefore, depending on the operating temperature range, at least part of, or substantially all of, the at least one component of the dry air may be removed by the cryogenic module 5 as outlined above.

This will ensure that at least part of, or substantially all of, any carbon dioxide component in the dry air, upon passage through the heat exchanger 33, will de-sublimate onto a surface of the heat exchanger 33 and no longer travel with the dry air stream. Other components of the air, for instance sulfur dioxide which condensates at only −10° C., will also condensate onto a surface of the heat exchanger 33 and no longer travel with the dry air stream. In this way, the temperature of the heat exchanger 33, if chosen appropriately, may remove part of more than just one component of the air, and may remove part of, or substantially all of, multiple components of the air, if desired and configured as such.

While the cryogenic module 5 need only include at least one heat exchanger and at least one cryogenic cooler 33, 35, in the form shown, the cryogenic module 5 includes three heat exchangers 33, 37 and 41 respectively coupled to three cryogenic coolers 35, 39 and 43, thereby forming three heat exchanger/cryogenic cooler pairs.

However, it should be noted that in some configurations, the cryogenic module 5 may instead comprise any number of heat exchangers coupled to any number of cryogenic coolers, such that not every individual heat exchanger is coupled to its own respective cryogenic cooler. For instance, a single cryogenic cooler may be coupled to multiple heat exchangers, depending on commercial requirements. Therefore, while the below description makes reference to heat exchanger/cryogenic cooler pairs, the below described features and functions of the cryogenic module 5 of FIG. 1 apply equally to embodiments of the cryogenic module 5 that do not possess a separate respective cryogenic cooler coupled to every individual heat exchanger.

In any case, the cryogenic module 5 can be configured in a staged manner, with multiple stages of heat exchangers each operating at successively lower temperature ranges regardless of whether they are each coupled to their own respective cryogenic cooler, such as in the exemplary embodiment of FIG. 1, or whether they share the at least one, or multiple, cryogenic coolers.

For instance, the first heat exchanger/cryogenic cooler pair 33, 35 of FIG. 1 can operate at about −10° C. to about −45° C., thereby removing at least part of, or substantially all of, a sulfur dioxide component, a formaldehyde component and a hydrogen sulfide component from the air stream, each of which start to condense at −20° C. and −42° C. respectively.

Then, the second heat exchanger/cryogenic cooler pair 37, 39 can operate at about −62° C. to about −80° C., thereby removing at least part, or substantially all of, of a hydrogen disulfide component, which starts to condensate at −62° C., and a carbon dioxide component, which starts to de-sublimate at −80° C., from the air stream.

A final stage of cooling is then provided by the third heat exchanger/cryogenic cooler pair 41, 43 operating at about −125° C., to remove at least part of, or substantially all of, an ozone component, which starts to condensate at −122° C.

This modular arrangement afforded by the cryogenic module 5 provides several benefits with regard to the purging arrangement 49 described in further detail below, and also allows the cryogenic module 5, and each of the heat exchangers and/or cryogenic coolers to be configured based on the variety of components of the air that are desired for removal. For instance, in some applications, such as a commercial building, it may only be required to remove at least part of, or substantially all of, a sulfur dioxide and formaldehyde component, and so only one heat exchanger/cryogenic cooler pair is provided operating at about −10° C. to about −45° C.

However, in for instance a clinical application, where substantial removal of most undesirable components of air may be required, a single heat exchanger/cryogenic cooler pair can be provided operating at about −125° C., or a plurality of heat exchanger/cryogenic cooler pairs can be provided, each successively dropping the temperature of the air to a final temperature of about −125° C.

In any case, the condensation or de-sublimation of at least part of at least one component of the dry air onto a surface of any one of the at least one heat exchanger substantially converts the dry air into treated air. The treated air may still retain some amount of each of the components that are removed, however the partial pressure of each component is substantially reduced so that the dry air is converted into substantially treated air having a minimum amount of contaminants or undesirable components. In some embodiments, the treated air may not retain any amount of each of the components, if configured as such.

The passage of the dry air through the successive stages of heat exchangers and cryogenic coolers is illustrated by cryogenic entry line 45. Whether only one stage is provided, or three as shown in FIG. 1, the dry air, once cooled to the minimum temperature desired for a particular application of the system 100, is converted to treated air passing along cryogenic exit line 47. The treated air passing along cryogenic exit line 47 escapes the cryogenic module 5 through the second full-system purge valve 64, described in further detail below, to travel along treated air line 11 back to the inhabited space 1.

The heat exchangers 33, 37, 41 of this embodiment are shown as counter-flow type heat exchangers with multiple counter-flow passages. The cryogenic entry line 45 forms one of these counter-flow passages, by traveling through each heat exchanger 33, 37, 41 of the cryogenic module 5. The cryogenic exit line 47 forms another one of these counter-flow passages, by traveling back through each heat exchanger 41, 37, 33.

The treated air flowing along the cryogenic exit line 47, having already passed through the heat exchangers 33, 37, 41, will be at a much lower temperature than the dry air entering the cryogenic module 5 through the cryogenic entry line 45. In this way, the heat of the dry air is at least partly absorbed by the treated air flowing back through the cryogenic exit line 47. This helps to reduce the workload on each respective heat exchanger/cryogenic cooler pair, and thus increase the overall efficiency of the cryogenic module 5.

Therefore, the cryogenic module 5 is configured such that at least a part of the energy required to decrease the temperature of the dry air as it passes through the at least one heat exchanger 33, 37, 41 is recovered by the passage of the treated air through the at least one heat exchanger 33, 37, 41.

Each heat exchanger and cryogenic cooler may be provided with temperature sensors such as first heat exchanger sensor 34, first cryogenic cooler sensor 36, second heat exchanger sensor 38, second cryogenic cooler sensor 40, third heat exchanger sensor 42 and third cryogenic cooler sensor 44, These sensors 34, 36, 38, 40, 42, 44 may measure and monitor a temperature of their respective heat exchanger/cryogenic cooler to ensure they are operating at the desired temperatures as required for removal of components of the dry air and/or purging of said components as described below.

The overall efficiency of the air treatment system 100 is also improved by the provision and configuration of a purging arrangement 49 responsible for removing components of the air built-up on surfaces of the heat exchangers 33, 37, 41. The build-up of components on surfaces of the heat exchangers 33, 37, 41 will gradually cause a change between the set operating temperature of a given heat exchanger and the monitored temperature of the heat exchanger, indicating a gradual decrease in efficiency. Therefore, provision of the purging arrangement 49 ensures that the optimal efficiency of the cryogenic module 5, and thus air treatment system 100, is maintained over time.

In the form shown, the purging arrangement 49 is provided in between the air preparation module 3 and the cryogenic module 5. However, in some embodiments, the purging arrangement 49 may be incorporated into the cryogenic module 5.

In any case, the air treatment system 100 may further comprise a purging arrangement 49 configured to remove the at least part of, or substantially all of, the at least one component of the dry air captured by the at least one heat exchanger 33, 37, 41 from the at least one heat exchanger 33, 37, 41.

The removal of the components of the dry air built-up onto surfaces of the heat exchanger/s 33, 37, 41 is performed selectively on individual pairs of heat exchangers/cryogenic coolers. However, in some configurations, all the pairs of heat exchangers/cryogenic coolers can also be purged concurrently, as described in further detail below.

In any case, the air treatment system 100 may monitor the temperatures of the heat exchangers (using, for instance, temperature sensors 34, 38, 42 described above) and measure temperature changes as components removed from the dry air build-up on the heat exchangers; the temperature change being used to calculate the amount of build-up, and thus determine when purging is required.

Purging is achieved through a plurality of valves that form part of the purging arrangement 49 and control its operation. The first of these valves is the purging entry valve 51 and the purging diversion valve 53.

When the purging arrangement 49 is activated, the purging entry valve 51 closes, preventing entry of dry air from the dry air line 9 into the cryogenic entry line 45, and thus into the cryogenic module 5. Simultaneously, the purging diversion valve 53 opens, providing passage of the dry air from the dry air line 9 to the treated air line 11.

In effect, operation of the purging arrangement 49 causes the flow of dry air exiting the air preparation module 3 to divert past the cryogenic module 5 and re-enter the inhabited space 1 via the air handling module 13. Therefore, during purging, the inhabited space 1 is temporarily provided with substantially dry, substantially particulate-free air, that is corrected for temperature and humidity by the air handling module 13 before re-entry, rather than treated air.

In this way, the air treatment system 100 is configured such that, during removal of the at least part of, or substantially all of, the at least one component of the dry air from the at least one heat exchanger 33, 37, 41 by the purging arrangement 49, the dry air is directed from the air preparation module 3 for delivery into the inhabited space 1.

While this occurs, a second pair of valves, corresponding to a given heat exchanger/cryogenic cooler pair, will open, depending on which heat exchanger/cryogenic cooler pair is selected for purging.

For instance, if the second heat exchanger/cryogenic cooler pair 37, 39 is selected, the secondary purging entry valve 55 is opened as well as the secondary purging exhaust valve 57. Some of the dry air traveling from dry air line 9 through the open purging diversion valve 53 will now be provided with an alternative passage through secondary purging entry valve 55.

Some of the dry air will thus travel through the secondary purging entry valve 55 and thus join the cryogenic entry line 45 at a position along the cryogenic entry line 45 downstream of the first cryogenic cooler 35 and upstream of the second heat exchanger 37. The dry air will pass through the second heat exchanger 37, then exit the cryogenic entry line 45 at a position along the cryogenic entry line 45 downstream of the second heat exchanger 37 and upstream of the third cryogenic cooler 39, to then pass through secondary purging exhaust valve 57. The secondary purging exhaust valve 57 then directs the air to an exhaust means.

This process of circulating air through the second heat exchanger 37 will continue until the temperature of the heat exchanger 37 rises past the evaporation temperature of the built-up components. Therefore, whichever heat exchanger is selected for purging will have its corresponding cryogenic cooler temporarily turned off so as to reduce the amount of time it takes for the air travelling through the chosen heat exchanger to rise in temperature. This process also helps to remove contaminants or components of the air built-up on the air flow lines or other components in or around the chosen heat exchanger/cryogenic cooler pair.

Once the chosen heat exchanger is sufficiently purged of built-up components, the secondary purging entry valve 55 and secondary purging exhaust valve 57 are closed and the second cryogenic cooler 39 is activated once more to return the second heat exchanger 37 back to its desired cryogenic temperature. The temperature required to evaporate or purge a solidified component from a surface of a given heat exchanger is typically not much higher than the cryogenic operating temperature required to condense or de-sublimate that same component. Therefore, once the purging diversion valve 53 is closed, and the purging entry valve 51 is reopened to allow re-entry of the dry air from the dry air line into the cryogenic module via cryogenic entry line 45, the second heat exchanger/cryogenic cooler pair 37, 39 will quickly return to operating temperature.

While purging of the second heat exchanger/cryogenic cooler pair 37, 39 occurs, the other heat exchanger/cryogenic cooler pairs will remain in operation, although no air stream flows through them. In this way, the other pairs remain at their desired operating temperature, therefore only the thermal mass of the pair chosen for purging needs to be heated for purging, then cooled down again to operating temperatures. This significantly reduces the energy consumption required for purging an individual heat exchanger/cryogenic cooler pair.

Further, because the pairs are configured for a specific range of operating temperatures corresponding to a given de-sublimation and/or condensation temperature of a component or components, as described above, the purging temperature required will correspond to the evaporation and/or de-sublimation temperatures of those same components. In this way, the difference between the purging temperature and the operating temperature is minimised for each given pair. This further reduces the energy consumption required for purging individual pairs of heat exchangers/cryogenic coolers.

However, it should be noted that all pairs can be purged simultaneously if desired as described below. Even in that case, each pair nonetheless possesses its own minimal difference between the purging temperature and the operating temperature. Even though all the pairs are being purged, the purging remains discretised so that the energy consumption is reduced thanks to each individual thermal mass only going through a discrete temperature change unique to that pair; as opposed to the combined thermal mass going through the same, much larger change (for instance, a change from the operating temperature of the coldest operating pair to the highest required evaporation temperature of a given component captured by one of the pairs).

It should be noted that like the second heat exchanger/cryogenic cooler pair 37, 39 shown in FIG. 1, the third heat exchanger/cryogenic cooler pair 41, 43 are also provided with corresponding purging valves, tertiary purging entry valve 59 and tertiary purging exhaust valve 61, which operate in the same manner in conjunction with the purging entry valve 51 and the purging diversion valve 53, as the secondary purging entry valve 55 and secondary purging exhaust valve 57 described above.

It should also be noted that the first heat exchanger/cryogenic cooler pair 33, 35, does not itself possess its own purging entry valve. Instead, unlike the other second, third, fourth etc. pairs of heat exchangers/cryogenic coolers, if the first heat exchanger/cryogenic cooler pair 33, 35 is selected for purging, the purging entry valve 51 remains open rather than closed.

The purging diversion valve 53 also remains open, so that only part of the dry air enters the first heat exchanger 33 through cryogenic entry line 45, much like purging of the other pairs. The first heat exchanger/cryogenic cooler pair 33, 35 is however provided with a corresponding first purging exhaust valve 63, which operates in the same manner as the secondary purging exhaust valve 57 described above, to circulate air through the first heat exchanger 33.

During a full-system purge, all cryogenic coolers 35, 39, 43 are temporarily turned off, and purging entry valve 51, first purging exhaust valve 63, and a first full-system purge valve 62 are opened, while purging diversion valve 53 and the second full-system purge valve 64 are closed. As such, a closed-loop circulation of dry air through the cryogenic module 5 is created as the dry air travelling along dry air line 9 is diverted through both the cryogenic entry line 45 and cryogenic exit line 47. This purges all the heat exchangers and associated flow lines or other components, then exhausts the purged components out through the first purging exhaust valve 63.

It should also be noted that in some embodiments, air other than dry air from the dry air line 9 can be used for purging. For instance, a supplementary purging line (not shown) can be provided which supplies pre-heated air for a faster change from operating temperature to purging temperature for a given heat exchanger/cryogenic cooler pair. However, in such an embodiment, the dry air from the dry air line 9 is still diverted away from the cryogenic module 5 for correction by the air handling module 13 and re-entry into the inhabited space 1.

FIG. 1 shows two alternative embodiments of a nitrogen discharge module. Since nitrogen forms a large component of air, removal of a nitrogen component (in addition to removal of components in the cryogenic module 5) can be an effective way to increase the oxygen-content and thus improve the quality of a given air stream.

The first of these embodiments is shown incorporated within the cryogenic module 5, and comprises a distillation column 65, nitrogen discharge line 67 and first nitrogen discharge valve 69. The second of these embodiments is shown more generally as part of the air treatment system 100, and is provided after the cryogenic module 5 branching off the treated air line 11, and comprises a nitrogen diversion line 71, gas separator 73, second nitrogen discharge valve 75, and nitrogen diversion valve 77.

These embodiments present alternatives to removing nitrogen from the treated air prior to delivery to the inhabited space 1, as described below, however they are both shown in the embodiment of the air treatment system 100 of FIG. 1. The air treatment system 100 may have one, both, or neither, of the nitrogen discharge modules.

In the first embodiment of the nitrogen discharge module, treated air having passed through the plurality of heat exchangers 33, 37, 41 enters the distillation column 65. The distillation column 65 operates at extremely low temperatures, at around −180° C. or lower, the temperature required to separate oxygen from a gas stream. Therefore, at least part of the treated air entering the distillation column 65 is separated into treated, nitrogen-reduced oxygen-enriched air and a nitrogen-rich gas stream. The treated, nitrogen-reduced oxygen-enriched air continues through to cryogenic exit line 47. The nitrogen-rich gas stream continues through nitrogen discharge line 67.

Like the cryogenic exit line 47, the nitrogen discharge line 67 passes through one of the counter-flow passages of the heat exchangers 41, 37, 33. Therefore, since the nitrogen-rich gas stream travelling along the nitrogen discharge line 67 is at a very low temperature, it will at least partly absorb the heat of the counterflow dry air travelling along the cryogenic entry line 45.

This helps to reduce the workload on each respective heat exchanger/cryogenic cooler pair, and thus increase the overall efficiency of the cryogenic module 5, when this first embodiment of the nitrogen discharge module is provided. Therefore, this first embodiment of the nitrogen discharge module is configured such that at least a part of the energy required to decrease the temperature of the dry air as it passes through the at least one heat exchanger 33, 37, 41 is recovered by the passage of the nitrogen-rich gas stream through the at least one heat exchanger 33, 37, 41.

The nitrogen-rich gas stream will then be discharged through opening of the first nitrogen discharge valve 69, while the treated, nitrogen-reduced oxygen-enriched air flows from the cryogenic exit line 47 to the treated air line 11 for correction and re-entry into the inhabited space 1 by the air handling module 13.

In the second embodiment of the nitrogen discharge module, the treated air has left the cryogenic module 5 and travels through the treated air line 11. The second nitrogen discharge valve 75 arranged on the nitrogen diversion line 71 opens, and the nitrogen diversion valve 77 arranged on the treated air line 11 closes, causing the treated air to divert along the nitrogen diversion line 71 rather than continue through the treated air line 11.

This leads the treated air to the gas separator 73 which then separates and removes a nitrogen component from the treated air. The gas separator 73 may take the form of a pressure-swing adsorber for example, which comprises an adsorbent that is configured to preferentially adsorb nitrogen from an air stream flowing therethrough. The treated, nitrogen-reduced oxygen-enriched air then re-joins the treated air line 11 for correction and re-entry into the inhabited space 1 by the air handling module 13.

The gas separator 73 may provide the treated, nitrogen-reduced oxygen-enriched air at a different pressure and density to the treated air flowing through the treated air line 11. Therefore, in embodiments where the optional expansion device 26 is provided, the nitrogen diversion line 71 may re-join the treated air line 11 at a position downstream of the expansion device 26, so that the expansion device 26 is configured based only on the pressure of the treated air in the treated air line 11.

In the first embodiment nitrogen discharge module, the distillation column 65 operating at extremely low temperatures, at around −200° C., demands a significant supply of energy to maintain that temperature. Therefore, the first embodiment nitrogen discharge module is generally only provided if one pair of the heat exchangers/cryogenic coolers is already set to operate at a similar temperature range, such that the distillation column can be coupled to or draw on the cooling capacity of the respective cryogenic cooler.

Thus, in applications where it is desired to remove components with a very low condensation/temperature range, then the first embodiment nitrogen discharge module will be provided as the system 100 as a whole is already drawing the energy needed to bring a cryogenic cooler to such temperatures.

However, in less intensive applications, say for instance a heat exchanger/cryogenic cooler pair operating at only around −45° C., the first embodiment nitrogen discharge module may require too much additional energy to bring the distillation column 65 to the required temperatures. Instead, the second embodiment nitrogen discharge module is provided, with the gas separator 73 drawing less energy to remove nitrogen as it does not use cryogenic separation to do so but less energy-intensive pressure-swing adsorption (or any other suitable non-cryogenic separation methods).

In any case, the air treatment system 100 may comprise a nitrogen discharge module configured to receive at least part of the treated air to decrease a concentration or partial pressure of a nitrogen component of the treated air prior to delivery of the treated air into the inhabited space 1.

Further, the volume flow rate of the at least part of the dry air received by the nitrogen discharge module, (whether that be the volume flow rate of the treated air entering the distillation column 65 of the first embodiment nitrogen discharge module, or the volume flow rate of the treated air entering the gas separator 73 of the second embodiment nitrogen discharge module) is determined by a concentration of an oxygen component of the treated air and/or a concentration of an oxygen component of the air within the inhabited space.

In this way, the air treatment system 100 monitors the concentration or partial pressure of an oxygen component of the air within the inhabited space 1 as well as the air travelling through any given component of the air treatment system 100, to determine how much nitrogen removal is required. This allows the system 100 to actively monitor oxygen levels to adjust operation of the nitrogen discharge module, therefore maintaining a desired oxygen concentration or partial pressure within the inhabited space 1. Measurement of the concentration or partial pressure of an oxygen component of the treated air and/or of an oxygen component of the air within the inhabited space 1 may be performed with the pre-correction sensor 14 or post-correction sensor 24 described above, or any other suitable sensor arrangement.

An alternative embodiment of the nitrogen discharge module not shown in FIG. 1 may also be provided in between the air preparation module 3 and the cryogenic module 5, along the dry air line 9. Therefore, as an alternative to the first and second embodiments described above, the air treatment system 100 may instead comprise a nitrogen discharge module configured to receive at least part of the dry air to decrease a concentration or partial pressure of a nitrogen component of the dry air prior to receipt of the dry air by the cryogenic module 5.

Being positioned prior to and external the cryogenic module 5, this alternative embodiment nitrogen discharge module may comprise similar working principles and features to the second embodiment described above. For instance, a gas separator taking the form of a pressure-swing adsorber may be provided along dry air line 9 to decrease a concentration or partial pressure of a nitrogen component of the dry air. A nitrogen diversion line, branching off the dry air line 9, and a nitrogen diversion valve provided along the dry air line 9, in a similar manner to the second embodiment described above, may be provided to control the amount of dry air sent into the gas separator. Finally, a nitrogen discharge valve may then exhaust the nitrogen-rich gas stream, while the substantially nitrogen-free dry air continues onto the cryogenic module 5.

In embodiments of the cryogenic module 5 where a nitrogen component is desired to be removed, this embodiment may beneficially reduce the required cooling load of the cryogenic module 5, as it may substantially remove the majority of the nitrogen component in the dry air prior to entering the cryogenic module 5. The cryogenic cooler(s) of the cryogenic module 5 thus may not need to drop to the liquefaction (condensation) temperature of oxygen/nitrogen of −180° C./190° C., which requires significant energy.

Further, like the first and second embodiments described above, an air treatment system having this alternative embodiment of the nitrogen discharge module may actively monitor oxygen levels to adjust operation of the nitrogen discharge module, therefore maintaining a desired oxygen concentration or partial pressure within the inhabited space 1. As such, the volume flow rate of the at least part of the dry air received by the nitrogen discharge module is determined by a concentration of an oxygen component of the dry air and/or a concentration of an oxygen component of the air within the inhabited space 1.

It should be noted that while the above described embodiments of the nitrogen discharge module produce substantially nitrogen-free air predominately through removal of at least part of a nitrogen component of the air stream, the air stream can additionally or alternatively be supplemented with a supply of pure oxygen gas or substantially oxygen-rich gas to further maintain a desired oxygen concentration or partial pressure within the inhabited space 1. This can be achieved for instance through supply of bottled or piped oxygen to the treated air prior to its entry into the inhabited space 1. Therefore, in some embodiments, the air treatment system 100 is configured to increase a concentration or partial pressure of an oxygen component of the treated air prior to delivery of the treated air into the inhabited space The air treatment system 100 is generally provided to improve the air quality of the air of an inhabited space 1. As described above in relation to various features of the system 100, in addition to the decrease in moisture and particulate content, the improvement in air quality is predominately achieved by separation, removal and/or reduction in the concentration or partial pressure of components of the air.

For instance, the cryogenic module 5 is configured to decrease a temperature of the dry air such that at least part of at least one component of the dry air is separated and removed from the dry air. The amount of the decrease in temperature of the dry air is determined by at least one property of the at least one component of the air within the inhabited space 1. As outlined previously, this at least one property of the at least one component of the air within the inhabited space 1 comprises a condensation temperature and/or a de-sublimation temperature.

Therefore, the cryogenic module 5 is configured based on which components of the air are desired to be removed. An installer of the system may first identify the various components of the air of an inhabited space 1, and depending on commercial requirements, select which components need to be substantially removed. The installer may then determine the required decrease in temperature, and thus design the cryogenic module 5 to suit, such as the number of heat exchangers or cryogenic coolers, and their associated operating temperatures. Therefore, the cryogenic module 5 will generally be configured based on pre-determined parameters. However, those skilled in the art will appreciate that some of those parameters may be adjusted, such as operating temperatures, should commercial requirements change.

However, other aspects of the air treatment system 100 may be actively monitored and adjusted to suit changing parameters if required.

For instance, the air treatment system 100 can be configured to control how much air extracted from the inhabited space 1 is actually received by the air treatment system 100 and thus treated for re-entry into the inhabited space. This can be achieved by controlling the volume flow rate of the extracted air processed by the air preparation module 3, for instance, by controlling the operational duty cycle of the compressor 25 and/or by controlling the volume flow rate of the extracted air leaving the cryogenic module 5, for instance through adjustment of the extent to which the second full-system purge valve 64 is open to allow treated air to leave the cryogenic module.

Alternatively, or additionally, instead of adjusting the volume flow rate of air entering the air treatment system 100, the increase in pressure of the extracted air may instead be reduced so as to slow the rate at which the extracted air is compressed. This can be achieved by, for instance, adjusting the target pressure of the compression device 25 of the air preparation module 3.

In either case, the air treatment system 100 may actively monitor certain properties of the components of the air within the inhabited space 1, and then adjust the proportion of that air passed to the cryogenic system for subsequent treatment. This may occur in conjunction with adjusting the volume flow rate of air being recirculated by, or extracted/returned from/to the inhabited space 1, by the air handling module 13, as outlined above, such that stable, gradual adjustment and control of air properties and uniform distribution of said air within the inhabited space 1 is achieved.

The air treatment system 100 may comprise a controller 102 in communication with the components of the air treatment system 100 (including components of the air preparation module 3 and cryogenic module 5) and the air handling module 13 to control the air treatment system 100 and/or air handling module 13 based on sensed and/or entered parameters, to provide the functionality and implement the method described herein.

The controller 102 can be any suitable type, such as a programmable logic control (PLC) unit or embedded controller for example.

The controller 102 and/or components may be in communication with various sensors 14, 24, 34, 36, 38, 40, 42, 44 as shown in FIG. 1, or any other suitable sensor arrangements, to sense parameters and control the components based on the sensed parameters.

A user interface (not shown) may be provided in the inhabited space 1 or elsewhere. The user interface will be in communication (either wired, wireless, or otherwise) with the controller 102 to enable user-input of operating parameters of the system.

The air treatment system 100 can be configured such that a volume flow rate of the extracted air received by the air preparation module 3 and/or an amount of increase in the pressure of the extracted air is determined by at least one current property of at least one component of the air within the inhabited space 1.

The at least one current property of the at least one component of the air within the inhabited space 1 comprises a concentration of the at least one component or a partial pressure of the at least one component. Thus, the air treatment system 100 will actively monitor the concentration or partial pressure of certain components within the inhabited space 1 desired for removal, then adjust the volume of air being treated as described above, so as to maintain desired levels of those components within the inhabited space 1.

Further, the at least one component of the air within the inhabited space 1 (that is actively monitored) and the at least one component of the dry air (that is removed by the cryogenic module 5) may comprises an oxygen component, a carbon dioxide component, a nitrogen component, a sulfur dioxide component, a formaldehyde component, a hydrogen sulfide component, a hydrogen disulfide component or an ozone component. Other components of the air may also be included in addition to those described, depending on the make-up of the air of the inhabited space 1.

In addition, as outlined above, the nitrogen discharge module may actively monitor the oxygen levels of air within the inhabited space 1 or within the system 100 itself, to determine the amount of decrease in the concentration or partial pressure of a nitrogen component of those air streams necessary to maintain a desired oxygen or nitrogen level within the inhabited space 1.

Measurement of the concentration or partial pressure of an oxygen component of the treated air and/or of an oxygen component of the air within the inhabited space 1 may be performed with the pre-correction sensor 14 or post-correction sensor 24 described above, or any other suitable sensor arrangement. Pre-correction sensor 14 and post-correction sensor 24, or any other suitable sensor arrangement, may also be used to actively measure the at least one current property of at least one component of the air within the inhabited space 1.

Thus, an installer may configure and install the cryogenic module 5 of the air treatment system 100 based on a desired removal of, for instance, a carbon dioxide component. The air treatment system 100 may therefore be installed with cryogenic operating temperatures of about −80° C. to about −140° C. in mind. The air treatment system 100 may also be configured based on parameters such as, for example, volume or area of the inhabited space 1, the expected number of occupants of the inhabited space 1, the desired carbon dioxide (or oxygen, or other components) concentration or partial pressure, desired temperature and/or desired humidity of the inhabited space 1. The air treatment system 100 may then actively monitor the concentration or partial pressures of carbon dioxide (or oxygen, or other components) within the air of the inhabited space 1, and adjust the amount of air being treated, or the amount of nitrogen being removed by the nitrogen discharge module, to maintain desired levels.

This functionality is especially useful since a change in the number of occupants within an inhabited space, as well as their activities, ventilation of the inhabited space or lack thereof, may all contribute to a changing concentration or partial pressure of, for instance, a carbon dioxide component. The air treatment system 100 therefore provides the benefit of actively adapting to and adjusting for changing parameters of an inhabited space 1. By contrast, conventional air conditioning systems or air purification systems must be pre-configured based largely on predicted parameters, and often cannot adapt to changing conditions of an inhabited space 1.

While various features and components of the air treatment system 100 have been described with reference to FIG. 1, those skilled in the art will appreciate the variety of substitutions, changes and variations possible on any one of these features or components. As such, the general method of treating air performed by the system 100 will now be described that may be performed by the system 100 of FIG. 1 and/or other embodiments thereof.

A method of treating the air of an inhabited space comprises first extracting the air from the inhabited space 1, then increasing the pressure of the extracted air so as to increase the density and decrease the moisture content of the extracted air, thereby converting the extracted air into dry air. The method then involves decreasing the temperature of the dry air such that at least part of at least one component of the dry air is separated and removed from the dry air, thereby converting the dry air into treated air, and then delivering the treated air into the inhabited space 1.

In some instances, the method may further comprise controlling an amount of the decrease in temperature of the dry air based on at least one property of the at least one component of the air within the inhabited space 1, wherein the at least one property of the at least one component may comprise a condensation temperature and/or a de-sublimation temperature.

The measured at least one current property of the at least one component of the air within the inhabited space 1 and the measured at least one current property of the at least one component of the dry air may comprise a concentration of the at least one component or a partial pressure of the at least one component.

Further, the at least one component of the air within the inhabited space 1 and the at least one component of the dry air may comprise an oxygen component, a carbon dioxide component, a nitrogen component, a sulfur dioxide component, a formaldehyde component, a hydrogen sulfide component, a hydrogen disulfide component or an ozone component, or some other component.

In some embodiments, the method may additionally involve measuring at least one current property of at least one component of the air within the inhabited space 1 and controlling a volume flow rate of the extracted air received by the air preparation module and/or controlling an amount of increase in the pressure of the extracted air based on the measured at least one current property.

Further, the method may involve measuring a concentration of an oxygen component of the dry air and/or a concentration of an oxygen component of the air within the inhabited space 1 and decreasing a concentration or partial pressure of a nitrogen component of the dry air based on the measured concentration prior to the decrease in temperature of the dry air.

Alternatively, the method may instead entail measuring a concentration of an oxygen component of the treated air and/or a concentration of an oxygen component of the air within the inhabited space 1 and decreasing a concentration or partial pressure of a nitrogen component of the treated air based on the measured concentration prior to delivery of the treated air into the inhabited space 1.

Further, the method may comprise increasing a concentration or partial pressure of an oxygen component of the treated air prior to delivery of the treated air into the inhabited space 1.

Finally, the method may comprise the steps of measuring and controlling a temperature, pressure, density and/or humidity of the treated air prior to delivery of the treated air into the inhabited space.

Embodiments described herein provide a substantially closed loop system that can operate to clean breathable air of unwanted particles and gases.

Embodiments described herein can maintain oxygen levels at a desired concentration by removing a prescribed amount of nitrogen. CO2 and/or other pollutants can be removed from the air and discharged to waste. The only outside air that may be used to achieve this is a small amount of makeup air to replace vented waste gases. Because minimal new air is required, the heating or cooling load is low. This provides significant efficiencies over systems that may require new air to be introduced of 10-50% of air movements, which would require considerable power in environs with high temperature differentials between indoors and outdoors.

Preferred embodiments of the invention have been described by way of example only and modifications may be made thereto without departing from the scope of the invention.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

DRAWING COMPONENTS

1—inhabited space
3—air preparation module
5—cryogenic module
7—extracted air line
9—dry air line
11—treated air line
13—air handling module
14—pre-correction sensor
15—air handling unit
17—fan
19—filter
21—humidity control device
23—temperature control device
24—post-correction sensor
25—compression device
26—expansion device
27—moisture collection arrangement
28—automatic valve
29—particle filter
31—dryer device
33—first heat exchanger
34—first heat exchanger sensor
35—first cryogenic cooler
36—first cryogenic cooler sensor
37—second heat exchanger
38—second heat exchanger sensor
39—second cryogenic cooler
40—second cryogenic cooler sensor
41—third heat exchanger
42—third heat exchanger sensor
43—third cryogenic cooler
44—third cryogenic cooler sensor
45—cryogenic entry line
47—cryogenic exit line
49—purging arrangement
51—purging entry valve
53—purging diversion valve
54—secondary purging entry valve
57—secondary purging exhaust valve
59—tertiary purging entry valve
61—tertiary purging exhaust valve
62—first full-system purge valve
63—first purging exhaust valve
64—second full-system purge valve
65—distillation column
67—nitrogen discharge line
69—first nitrogen discharge valve
71—nitrogen diversion line
73—gas separator
75—second nitrogen discharge valve
77—nitrogen diversion valve
102—controller

The invention claimed is:

1. An air treatment system for treating air of an inhabited space, the air treatment system comprising:

an air preparation module configured to receive air extracted from the inhabited space and configured to increase the pressure of the extracted air so as to increase the density and decrease the moisture content of the extracted air, thereby converting the extracted air into dry air; and a cryogenic module coupled to the air preparation module to receive the dry air and configured to decrease a temperature of the dry air such that at least part of at least one component of the dry air is separated and removed from the dry air thereby converting the dry air into treated air for delivery into the inhabited space.

2. The air treatment system of claim 1, further comprising an air handling module coupled to the air treatment system and configured to extract the air from the inhabited space and deliver it to the air preparation module and/or configured to receive the treated air from the cryogenic module and deliver it into the inhabited space.

3. The air treatment system of claim 2, wherein the air treatment system is configured such that a volume flow rate of the extracted air received by the air preparation module and/or an amount of increase in the pressure of the extracted air is determined by at least one current property of at least one component of the air within the inhabited space.

4. The air treatment system of claim 1, wherein the cryogenic module comprises:

at least one heat exchanger through which the dry air and the treated air pass and configured to capture the at least part of at least one component of the dry air to separate and remove the at least part of the at least one component from the dry air; and at least one cryogenic cooler coupled to the at least one heat exchanger and configured to control the temperature of the at least one heat exchanger.

5. The air treatment system of claim 1, wherein the air preparation module comprises:

a compression device configured to increase pressure of the extracted air to increase the density of the extracted air;

a moisture collection arrangement configured to capture moisture content from the extracted air during and/or after the increase in pressure and density of the extracted air; and at least one particle filter configured to capture particulate content from the extracted air after the decrease in moisture content of the extracted air.

6. The air treatment system of claim 1, further comprising a nitrogen discharge module configured to receive at least part of the dry air to decrease a concentration or partial pressure of a nitrogen component of the dry air prior to receipt of the dry air by the cryogenic module.

7. The air treatment system of claim 6, wherein a volume flow rate of the at least part of the dry air received by the nitrogen discharge module is determined by a concentration of an oxygen component of the dry air and/or a concentration of an oxygen component of the air within the inhabited space.

8. The air treatment system of claim 1, further comprising a nitrogen discharge module configured to receive at least part of the treated air to decrease a concentration or partial pressure of a nitrogen component of the treated air prior to delivery of the treated air into the inhabited space.

9. The air treatment system of claim 8, wherein a volume flow rate of the at least part of the treated air received by the nitrogen discharge module is determined by a concentration of an oxygen component of the treated air and/or a concentration of an oxygen component of the air within the inhabited space.

10. The air treatment system of claim 4, wherein the cryogenic module is configured such that at least a part of the energy required to decrease the temperature of the dry air as it passes through the at least one heat exchanger is recovered by the passage of the treated air through the at least one heat exchanger.

11. The air treatment system of claim 5, wherein the air treatment system is configured such that at least a part of the energy required to increase the density of the extracted air is recovered by directing the treated air through an expansion device coupled to the compression device before it is delivered into the inhabited space.

12. The air treatment system of claim 4, wherein the air treatment system further comprises a purging arrangement configured to remove the at least part of the at least one component of the dry air captured by the at least one heat exchanger from the at least one heat exchanger.

13. The air treatment system of claim 12, wherein the air treatment system is configured such that, during removal of the at least part of the at least one component of the dry air from the at least one heat exchanger by the purging arrangement, the dry air is directed from the air preparation module for delivery into the inhabited space.

14. The air treatment system of claim 1, wherein the cryogenic module is configured such that an amount of the decrease in temperature of the dry air is determined by at least one property of the at least one component of the air within the inhabited space.

15. The air treatment system of claim 14, wherein the at least one property of the at least one component of the air within the inhabited space comprises a condensation temperature and/or a de-sublimation temperature.

16. The air treatment system of claim 3, wherein the at least one current property of the at least one component of the air within the inhabited space comprises a concentration of the at least one component or a partial pressure of the at least one component, and wherein the at least one component of the air within the inhabited space and the at least one component of the dry air comprises an oxygen component, a carbon dioxide component, a nitrogen component, a sulfur dioxide component, a formaldehyde component, a hydrogen sulfide component, a hydrogen disulfide component or an ozone component.

17. The air treatment system of claim 2, wherein the air treatment system is configured to increase a concentration or partial pressure of an oxygen component of the treated air prior to delivery of the treated air into the inhabited space.

18. The air treatment system of claim 2, wherein the air handling module is configured to measure and control a temperature, pressure, density and/or humidity of the treated air prior to delivery of the treated air into the inhabited space.

19. The air treatment system of claim 2, wherein the air handling module comprises an air conditioning system.

20. A method of treating the air of an inhabited space, the method comprising:

extracting the air from the inhabited space;

increasing the pressure of the extracted air so as to increase the density and decrease the moisture content of the extracted air, thereby converting the extracted air into dry air;

decreasing the temperature of the dry air such that at least part of at least one component of the dry air is separated and removed from the dry air, thereby converting the dry air into treated air; and delivering the treated air into the inhabited space.

* * * * *